US007937893B2

(12) United States Patent
Pribisic

(10) Patent No.: US 7,937,893 B2
(45) Date of Patent: May 10, 2011

(54) INTUITIVE HANDLE SWITCH OPERATION FOR POWER SLIDING DOORS

(75) Inventor: Mirko Pribisic, North York (CA)

(73) Assignee: Magna Closures Inc., Newmarket (CA)

( * ) Notice: Subject to any disclaimer, the term of this patent is extended or adjusted under 35 U.S.C. 154(b) by 588 days.

(21) Appl. No.: 11/842,308

(22) Filed: Aug. 21, 2007

(65) Prior Publication Data

US 2008/0047199 A1 Feb. 28, 2008

Related U.S. Application Data

(60) Provisional application No. 60/839,302, filed on Aug. 22, 2006.

(51) Int. Cl.
*E05F 15/00* (2006.01)

(52) U.S. Cl. ..... 49/139; 296/1.02; 296/146.4; 296/155; 340/5.62; 340/5.72

(58) Field of Classification Search ..... 49/139, 49/140, 360; 296/146.4, 155, 1.02; 340/5.62, 340/5.72

See application file for complete search history.

(56) References Cited

U.S. PATENT DOCUMENTS

| | | | | |
|---|---|---|---|---|
| 5,422,552 | A * | 6/1995 | Parisi | 318/466 |
| 6,199,322 | B1 * | 3/2001 | Itami et al. | 49/139 |
| 6,218,933 | B1 * | 4/2001 | Josserand et al. | 340/426.28 |
| 6,323,565 | B1 | 11/2001 | Williams, Jr. et al. | |
| 6,435,600 | B1 * | 8/2002 | Long et al. | 296/155 |
| 6,779,372 | B2 * | 8/2004 | Arlt et al. | 70/237 |
| 7,158,044 | B2 * | 1/2007 | Monig et al. | 340/686.6 |
| 7,375,613 | B2 * | 5/2008 | Shelley et al. | 340/5.72 |
| 2002/0153744 | A1 * | 10/2002 | Long et al. | 296/155 |
| 2003/0216817 | A1 * | 11/2003 | Pudney | 700/17 |
| 2004/0031908 | A1 * | 2/2004 | Neveux et al. | 250/221 |
| 2007/0075828 | A1 * | 4/2007 | Mizushima et al. | 340/5.62 |
| 2009/0256677 | A1 * | 10/2009 | Hein et al. | 340/5.72 |
| 2010/0007463 | A1 * | 1/2010 | Dingman et al. | 340/5.72 |

* cited by examiner

*Primary Examiner* — Jerry Redman

(74) *Attorney, Agent, or Firm* — Alex Porat; Magna International Inc.

(57) ABSTRACT

The invention is a sliding door assembly operable move a vehicle door between an open and a closed position. The assembly includes a motor, reversibly operable to move the door towards one of the open and the closed position. A handle is mounted to the door and a handle sensor is provided, operable to detect the grasping of the handle. When the handle is grasped, a controller activates the motor to move the door when the handle sensor is triggered. Moving the door using the handle by at least a predetermined distance causes the controller to deactivate the motor, allowing manual movement of the door.

6 Claims, 2 Drawing Sheets

INTUITIVE HANDLE SWITCH OPERATION FOR POWER SLIDING DOORS

This application claims the benefit of U.S. Provisional Application No. 60/839,302, filed Aug. 22, 2006.

FIELD OF THE INVENTION

The present invention relates to power sliding doors typically used on minivans. More specifically, the present invention relates to the hardware and software used to control the activation and direction of movement for a power sliding door.

BACKGROUND OF THE INVENTION

Sliding doors provide a convenient access to the interior of a vehicle, but are often heavy and unwieldy to operate manually by smaller users. Power sliding door systems overcome the physical challenges posed by the heavy sliding doors. Using either a button or a micro-switch integrated into the door handle, a user can power open or close the door. In handle-operated systems, the micro-switch is typically used to inform electronic control module (ECM) of the power sliding door system that a user has grabbed or released the handle. If the ECM determines that the right conditions are met (such as opening the door only when it is unlocked), it engages the motor to open or close the door, as well as release the door latch (if necessary). In typical prior art power door systems, position sensors (such as bi-directional Hall Effect sensors) are usually built into the DC motor to provide control logic to the ECM.

However, power sliding door systems can seem slow or inconvenient compared to simple manual operation. Generally, the powered open or closing cycle does not intuitively mimic manual operation of the door, particularly if the user wishes to interrupt the cycle midway. Typical power sliding door systems cannot combine power door motion and manual inputs in an intuitive manner as the power door systems are typically 100% power activation (via the handle switches) or 100% manual activation (when the power system is deactivated). Some systems provide a power interrupt feature where grabbing the handle will stop a door from moving to the open or closed positions, allowing for manual operation of the door. Other power sliding door systems provide automatic direction reversal via the handle input switch, but offer no manual operation mode without deactivate the power sliding door system from elsewhere in the vehicle.

It is therefore desired to provide a power sliding door system that provides both powered and manual operation of the door via handle input. It is further desired to provide a power sliding door system that allows for both powered and manual door operation using just the handle without the need to activate or deactivate the power sliding door system using a separate switch.

SUMMARY OF THE INVENTION

According to the present invention there is provided a power sliding door assembly to move a vehicle door between an open and a closed position. The assembly includes a motor, reversibly operable to move the door towards one of the open and the closed position. A handle is mounted to the door and a handle sensor is provided, operable to detect the grasping of the handle. A controller, connected to the handle sensor activates the motor when the handle sensor is triggered and released without door motion. Moving the door by at least a predetermined distance, with handle sensor activated or released, causes the controller not to activate the motor, allowing manual movement of the door.

BRIEF DESCRIPTION OF THE DRAWINGS

Preferred embodiments of the present invention will now be described, by way of example only, with reference to the attached Figures, wherein.

DETAILED DESCRIPTION

Figure 1:
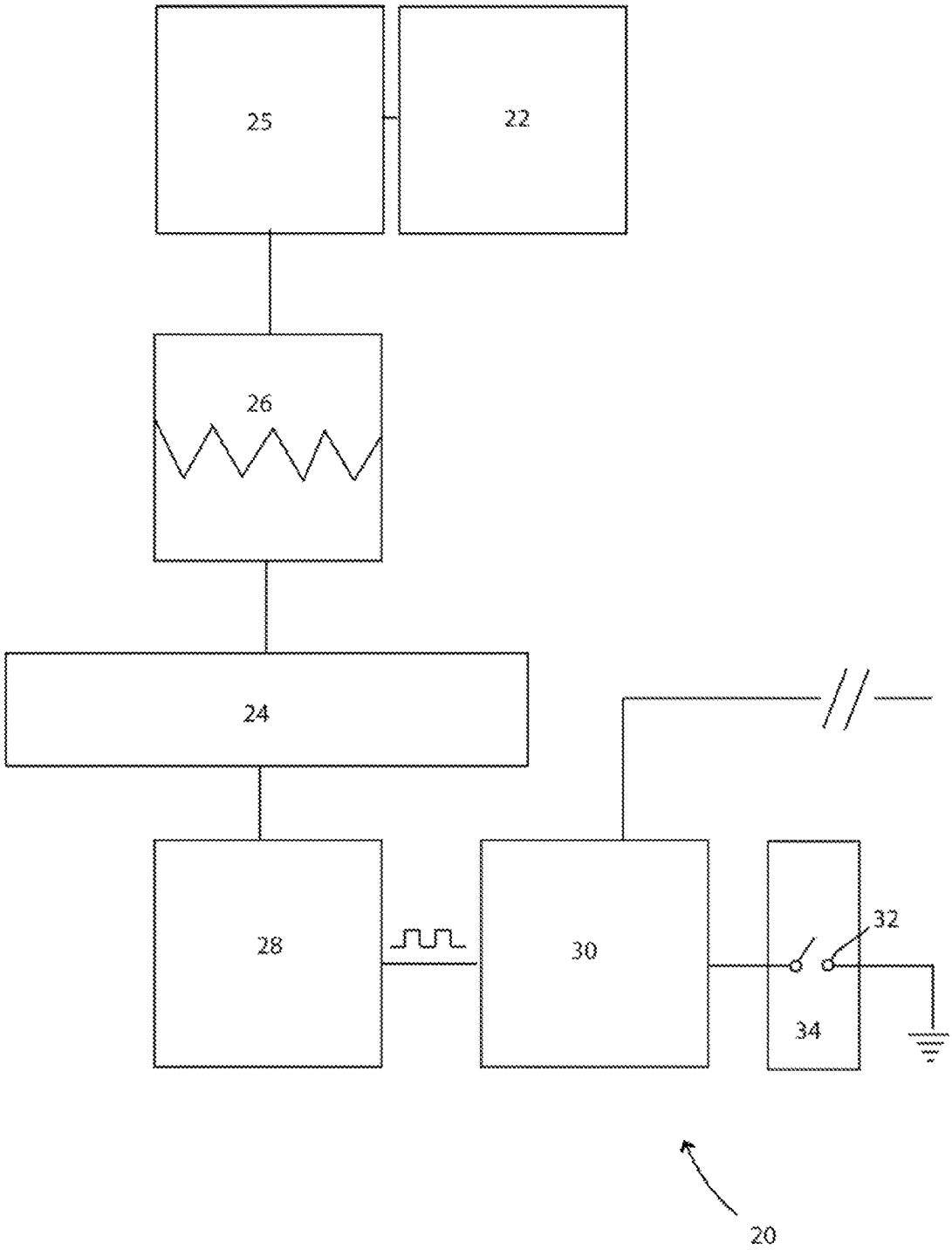
FIG. 1 shows a block diagram illustrating the primary components of a power sliding door system in accordance with an embodiment of the invention.

Referring now to FIG. 1, a vehicle door assembly having a power mode and a manual mode is schematically illustrated at 20. Door assembly 20 includes a reversible DC motor 22 located within the vehicle (not shown), operable to open or close a sliding door 24 when assembly 20 is in power mode. Sliding door 24 is a conventional sliding door adapted for a van or suchlike vehicle, and travels between a closed position and an open position along a track on the vehicle (also not shown). An output shaft on DC motor 22 is connected to a gear box 25 operable to increase torque and reduce end RPMs on motor 22. A clutch 26 interconnects the gear box 26 with sliding door 24, coupling the door and motor when motor 22 is engaged. When motor 22 is disengaged, clutch 26 decouples the motor from the sliding door as to enable manual mode operation without back driving the gearbox or motor.

A door position sensor 28 encodes the position of the door 24 between the open and closed positions, and relays its location to a controller 30 (typically an ECM). Controller 30 is operable to activate and deactivate motor 22, determine the direction of motor output and also direct ancillary functions such as actuating a power door latch when opening the door.

A handle switch 32 located with a door handle 34 provides the user input to controller 30. Handle 34 could be either an inside or an outside handle 34, or both. Inside handles 34 will preferably be shaped as bi-directional inside handles as known to those of skill in the art, and outside handles 34 will preferably be shaped as pull-strap handles, as known to those of skill in the art. Handle switch 32 is preferably a microswitch that is integrated into handle 34, and is operable to switch to an "on" state when a user has grasped handle 34 and switch back to an "off" state when the user releases the handle. The implementation of handle switch 32 is not particularly limited and can alternatively embody a capacitive sensor, motion detector or such device as will occur to those of skill in the art. The remainder of the mechanical elements and electronic circuitry involved in power door assembly 20 are omitted for the purposes of clarity.

As mentioned previously, in prior art power door assemblies, position sensors (such as bi-directional hall effect sensors) are typically located within the DC motor. In door assembly 20, position sensor 28 is integrated into either the side of door 24 or the door track side and continuously monitors the position of door 24 and relays this information to controller 30 even when door 24 is moved manually and motor 22 is not activated. Controller 30 can thus determine whether door 24 is closed, open or partially open at all points in the door's operation. Furthermore, controller 30 can determine the direction of motion and rate of acceleration in door 24 by recording changes in the position of door 24 over time. As is described in greater detail below, by receiving constant position data, controller 30 can be used to combine manual and power door operation interchangeably in both directions using a single handle switch 34.

To open or close the door 24 using power mode, the user will intuitively grab and release a handle 34 within a specified period of time, triggering handle switch 32 on and off. Controller 30 activates motor 22 to move door 24 from the open position to the closed position, or vice versa. When door 24 is partially open, position sensor 28 furthers determines whether door 24 is located within a predefined "high" zone or "low" zone. When door 24 is stopped in the high zone, activating handle switch 34 causes controller 30 to automatically move door 24 towards the closed position as the default action (i.e., without further input from the user), and when door 24 is stopped in the low zone, activating handle switch 34 will cause controller 30 to automatically move door 24 towards the open position as the default action. Typically, the high zone is predefined defined as when door 24 is located closer to the closed position, and the low zone can be defined as when door 24 is located closer to the open position. The arrangement of the higher zone and the lower zone is not particularly limited, and other configurations the two zones can be applied. For instance, the high zone can be defined as the one quarter of the range of door travel that is closest to the closed position, and the low zone can be defined as the remaining three quarters of the range of door travel that is closest to the open position.

If the user wishes to move door 24 towards the position opposite the default action (i.e., closing door 24 while it is in the low zone), a small push will cause controller 30 to detect either a change in the rate of door travel or a change in the direction of door travel. Controller 30 will then reverse motor 22 to move door 24 in the intended direction. If handle 34 is grabbed while door 24 is in motion towards either the open or the close position, controller 30 stops the motor 22, halting door movement. Alternatively, controller 30 could reverse the direction of door movement, if preferred.

To manually open or close the door 24, instead of grabbing and releasing handle 34, the user will continue to hold handle 34 (i.e., leaving handle switch 32 on) and intuitively pull door 24 the desired direction. Once controller 30 has detected that door 24 has moved a predetermined distance in a fixed period of time, it will switches system 20 into manual mode. Motor 22 will be deactivated and clutch 26 will be disengaged, allowing for free movement of door 22 between the open and the closed positions.

Figure 2:
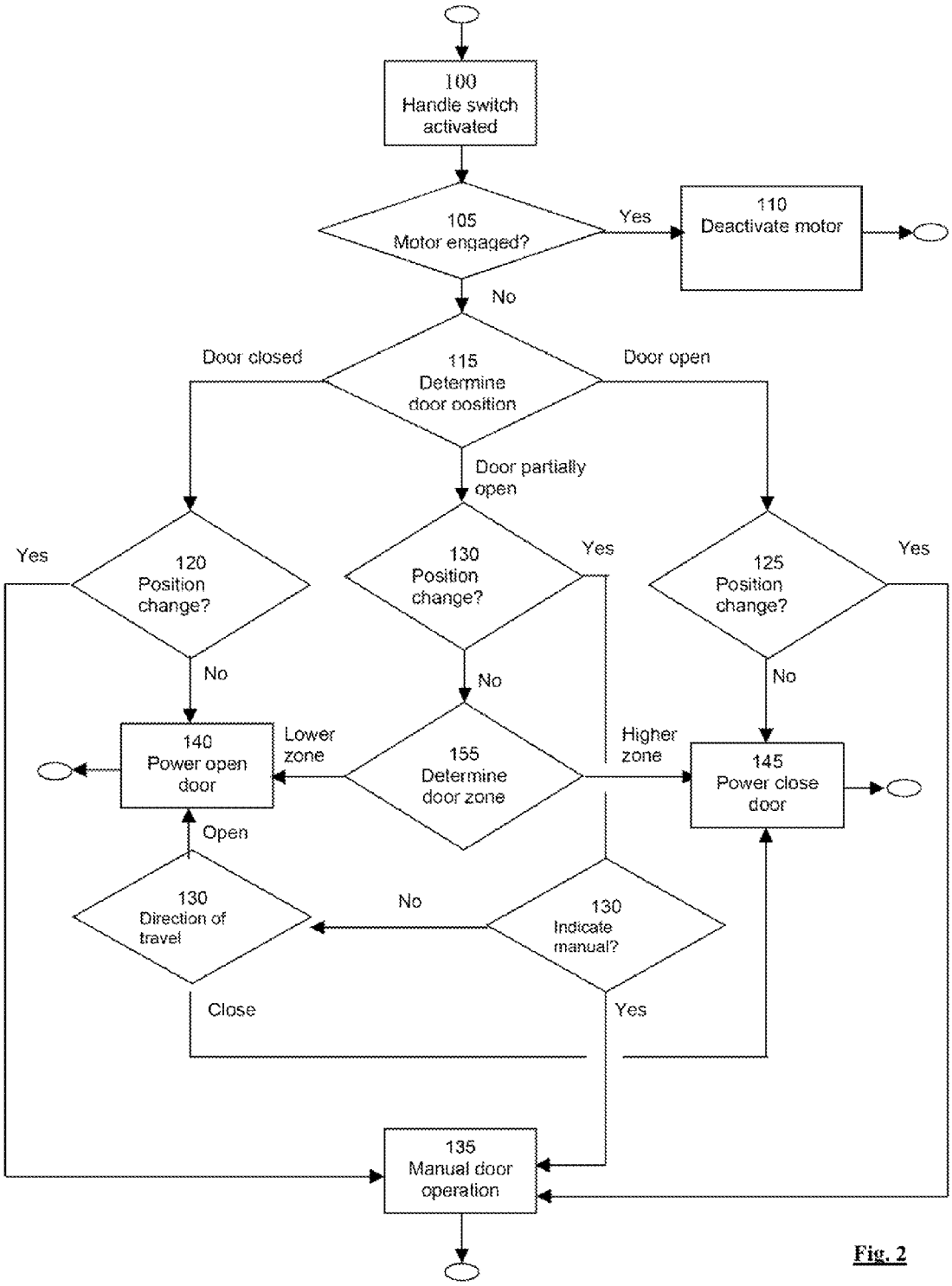
FIG. 2 shows a flow chart illustrating the operation of the power sliding door system depicted in FIG. 1.

Operation of the door assembly 20 shall be described in greater detail with reference to the flowchart shown in FIG. 2. Beginning at step 100, controller 30 detects the activation of the handle switch 32 when the user grasps handle 34. At step 105, controller 30 determines if motor 22 is currently engaged (i.e., sliding door system 20 is already in power operation mode). If motor 22 is engaged, the method advances to step 110 where controller 22 deactivates the motor, thus stopping movement of door 24 at its current position between the open and closed positions. Alternatively, if desired, triggering handle switch 32 while door 24 is in motion will reverse the direction of door 24. Other such variations will occur to those of skill in the art. Otherwise, if motor 22 is currently disengaged, the method advances to step 115.

At step 115, using the positional data supplied by position sensor 28, controller determines the initial position of door 22. If door 22 is in the closed position, the method advances to step 120; if door 22 is in the open position, the method advances to step 125, and if door 22 is partially open, the method advances to step 130.

At step 120, using the positional data supplied by position sensor 28, controller 30 determines whether door 24 moves during handle activation. If door 24 moves at least the predetermined distance, then the method advances to step 135. If door 24 does not move at least the predetermined distance, or a change in door position is not detected, the method advances to step 140.

At step 125, using the positional data supplied by position sensor 28, controller 30 determines whether door 24 moves during handle activation. If door 24 does move at least the predetermined distance, then the method advances to step 135. If door 24 does not move at least the predetermined distance, or a change in door position is not detected, the method advances to step 145.

At step 130, using the positional data supplied by position sensor 28, controller 30 determines whether door 24 moves during handle activation. If door 24 moves, then the method advances to step 150. If a change in door position is not detected, then the method advances to step 155.

At step 135, controller 30 switches door assembly 20 to manual operation. Clutch 26 is disengaged, allowing the user to freely slide door 24 open or closed.

At step 140, controller 30 switches power sliding door system 20 to power open mode. Motor 22 is activated, clutch 26 is engaged, and door 24 is moved to the open position. When door 24 reaches the open position, motor 22 is deactivated and clutch 26 is disengaged.

At step 145, controller 30 switches power sliding door system 20 to power close mode. Motor 22 is activated and moves door 24 to the closed position. When door 24 reaches the closed position, motor 22 is deactivated and clutch 26 is disengaged.

At step 150, using the positional data supplied by position sensor 28, controller 30 determines whether door 24 has moved at least the predetermined distance. If door 24 does move at least the predetermined distance, then the method advances to step 135 for manual operation. If door 24 does not move at least the predetermined distance, the method advances to step 160.

At step 155, using the positional data supplied by position sensor 28, controller 30 determines whether door 24 is located within the high zone or the low zone. If door 24 is located within the high zone, the method advances to step 145 to power close door 24. If door 24 is located within the low zone, the method advances to step 140 to power open door 24.

At step 160, using the positional data supplied by position sensor 28, controller 30 determines the direction of travel for door 24. If door 24 has moved towards the open position, then the method advances to step 140 and the controller switches to power open mode. If door 24 has moved towards the closed position, then the method advances to step 145 and the controller switches to power close mode.

Using the method described above, sliding door assembly 20 can operate in an intuitive manner in both power and manual modes. It can power open or close from any position. When in art intermediary positions between the open and closed positions, a user can simply and intuitively move the door to either the open or the closed position.

What is claimed is:

1. A power sliding door assembly comprising:

a door mounted in a vehicle to slide between an open and a closed position;

a motor, reversibly operable to move the door towards one of the open and the closed position;

a handle, mounted to the door;

a handle sensor, operable to detect the grasping of the handle;

a controller, connected to the handle sensor and operable to activate the motor when the handle sensor is activated; and wherein, when the door is stopped and the user grasps the handle so as to activate the handle sensor:

a) the controller activates the motor to begin to move the door, and b) in the event the door has moved a predetermined distance since the activation of the motor in step (a) and the handle has been grasped by the user so as to continuously activate the handle sensor throughout the movement of the door for said predetermined distance, the controller deactivates the motor to thereby permit the user to move the door manually, and c) in the event the handle sensor is deactivated during the movement of the door for said predetermined distance after the activation of the motor in step (a), the controller continues to activate the motor after the door has travelled for said predetermined distance;

said predetermined distance being less than the distance between the open and closed positions of the door.

2. The power sliding door assembly of claim 1, further including a position sensor operable to determine the position of the door relative to its open and closed position and relay the position to the controller, wherein the controller is programmed to determine the direction of door movement when the door is being moved using the motor.

3. The power sliding door assembly of claim 2, wherein grasping the handle so as to activate the handle sensor while the door is in the closed position cause the controller to activate the motor to move the door towards the open position.

4. The power sliding door assembly of claim 2, wherein grasping the handle so as to activate the handle sensor while the door is in the open position cause the controller to activate the motor to move the door towards the closed position.

5. The power sliding door assembly of claim 4, wherein grasping the handle so as to activate the handle sensor while the door is located between the closed position and the open position causes the controller to determine the location of the door and to activate the motor to move the door towards one of the open position and the closed position based upon the location of the door.

6. The power sliding door assembly of claim 5, wherein the handle sensor is mounted directly to the handle.

* * * * *